US007438606B2

(12) United States Patent
Pizzi

(10) Patent No.: US 7,438,606 B2
(45) Date of Patent: Oct. 21, 2008

(54) TERMINAL BLOCK FOR CONNECTING ELECTRIC CABLES

(75) Inventor: Giordano Pizzi, Milan (IT)

(73) Assignee: Morsettitalia S.p.A., Milan (IT)

( * ) Notice: Subject to any disclaimer, the term of this patent is extended or adjusted under 35 U.S.C. 154(b) by 0 days.

(21) Appl. No.: 12/014,561

(22) Filed: Jan. 15, 2008

(65) Prior Publication Data

US 2008/0171477 A1 Jul. 17, 2008

(30) Foreign Application Priority Data

Jan. 15, 2007 (IT) ..... MI2007A0045

(51) Int. Cl.
*H01R 11/09* (2006.01)

(52) U.S. Cl. ..... 439/793; 439/811

(58) Field of Classification Search ..... 439/793, 439/792, 811, 712, 709, 716, 812
See application file for complete search history.

(56) References Cited

U.S. PATENT DOCUMENTS 4,889,504 A * 12/1989 Barbier et al. ..... 439/712
5,553,787 A * 9/1996 Guginsky ..... 439/472
5,905,230 A * 5/1999 Marik ..... 174/651
6,475,038 B1 * 11/2002 Franck ..... 439/811
6,786,779 B2 * 9/2004 Feldmeier et al. ..... 439/729

* cited by examiner

*Primary Examiner*—Neil Abrams
*Assistant Examiner*—Phuong Nguyen
(74) *Attorney, Agent, or Firm*—Mintz, Levin, Cohn, Ferris, Clovsky and Popeo, PC; David F. Crosby

(57) ABSTRACT

Terminal block comprising a body having, formed internally, a chamber for housing a clamp for retaining the ends of electric cables or wire, which can be operated by an operating mechanism, at least two openings for introducing said wires, at least one opening for access to the operating mechanism, the clamp consisting of at least two jaws which are situated opposite each other in the direction (Z-Z) transverse to the longitudinal direction of the electric wires and respectively comprising at least one base and at least one pair of lugs which are discontinuous in the longitudinal direction (X-X) so as to define respective seats suitable for engagement in the vertical direction (Z-Z) with corresponding lugs of the other jaw and each of the lugs having a cross-section substantially in the form of an isosceles triangle.

15 Claims, 1 Drawing Sheet

Fig.1
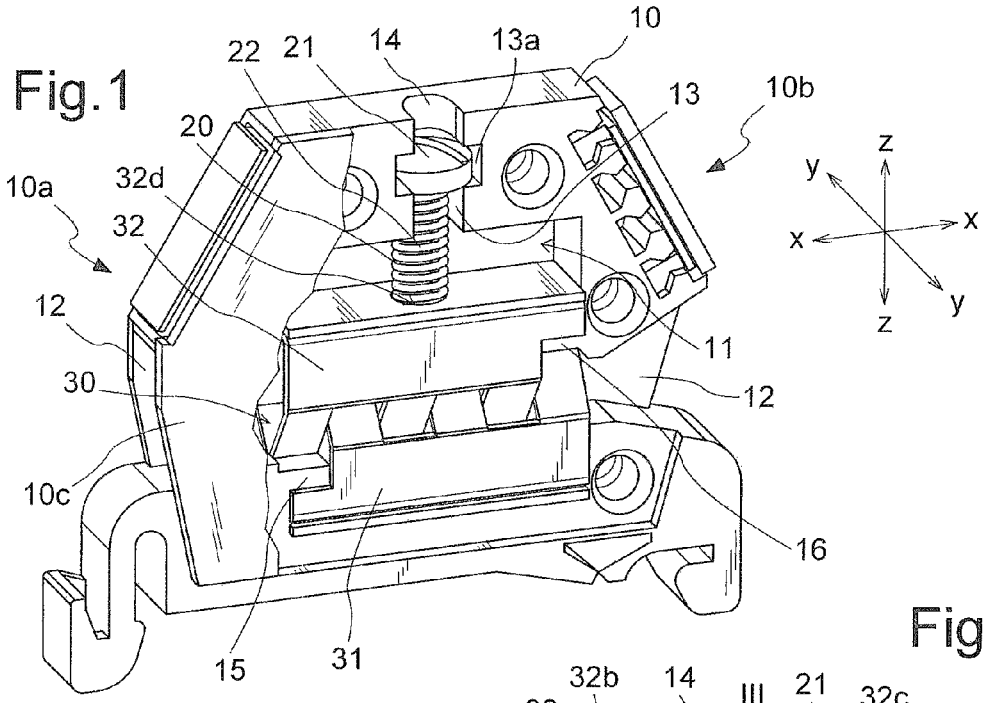
Fig.2
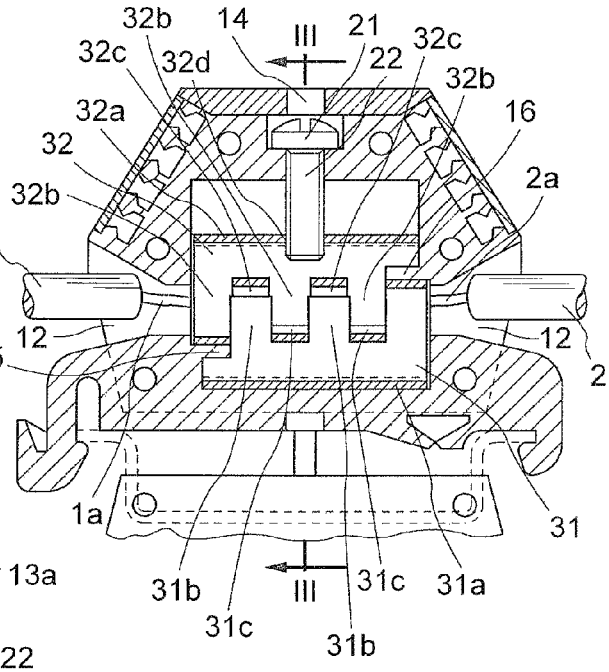
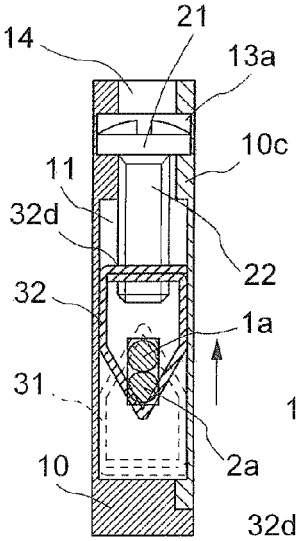
Fig.3a
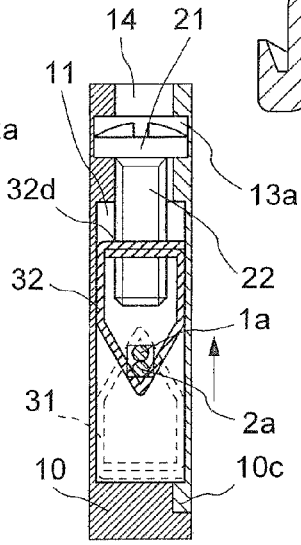
Fig.3b

TERMINAL BLOCK FOR CONNECTING ELECTRIC CABLES

BACKGROUND

1. Technical Field of the Invention

The present invention relates to a terminal block for connecting electric wires.

2. Description of the Prior Art

It is known in the technical sector relating to the manufacture of switchboards for the wiring of electrical installations to use terminal blocks which are able to be mounted on associated supports and have opposite side openings for introducing in the longitudinal direction discontinuous wires to be connected electrically together by tightening a part movable in the direction transverse to the longitudinal direction of the wires.

Although fulfilling their function, these known terminal blocks nevertheless have drawbacks in particular with regard to certain applications such as connection of the output wires from a thermocouple which, as is known, are made of a different material and must be connected without creating a difference in potential which would give rise to an incorrect measurement read off the instrument situated remotely.

Particular types of terminal blocks designed for these applications are also known and essentially comprise:

- two terminals forming the clamping part actuated by screws which can be operated externally and are joined to a small bar arranged between them and made of the same material as the wires to be connected together;
- a single terminal into which the two opposite wires are inserted and clamped together by means of two screws which can be operated externally.

In the first case this results in terminal blocks which are extremely precise, but which also have a high cost owing to the double terminals and the presence of the bars made of different material; in the second case the design is simplified, but at the cost of much less precision owing to the direct clamping action by means of screws.

In addition to this, the choice of materials and the dimensions of the connection (terminals plus screws) must be compatible with the material and the diameters of the wires to be connected, resulting in the need to produce and store a large number of different terminal blocks.

SUMMARY

The technical problem which is posed, therefore, is that of providing a terminal block for electrically connecting discontinuous wires, in particular for measuring instruments such as thermocouples and the like, which is able to ensure a very precise electrical connection without creating differences in potential and is essentially independent of the material and the cross-section of the wires to be connected.

In connection with this problem it is also required that this terminal block should consist of a small number of component parts and should be easy and inexpensive to produce and assemble and have minimum dimensions.

These results are obtained according to the present invention by a terminal block comprising a body having, formed internally, a chamber for housing clamping means for retaining the ends of electric cables, which can be operated by means of operating means, at least two openings for introducing said wires, at least one opening for access to said operating means, said clamping means consisting of at least two jaws which are situated opposite each other in the direction transverse to the longitudinal direction of the electric wires and respectively comprising at least one base and at least one pair of lugs which are discontinuous in the longitudinal direction so as to define respective seats suitable for engagement in the vertical direction with corresponding lugs of the other jaw and in that said lugs have a cross-section substantially in the form of an isosceles triangle able to contain inside them the electric wires to be connected.

Further details may be obtained from the following description of a non-limiting example of embodiment of the object of the present invention, provided with reference to the accompanying drawings in which:

BRIEF DESCRIPTION OF THE FIGURES

FIG. 1 shows a perspective view of a terminal block according to the present invention;

FIG. 2 shows a cross-section along a longitudinal vertical plane of the terminal block shown in FIG. 1;

FIG. 3*a* shows a schematic cross-section along the plane indicated by the line III-III in FIG. 2 with larger-diameter wires; and FIG. 3*b* shows a schematic cross-section along the plane indicted by III-III in FIG. 2 with smaller-diameter wires.

DETAILED DESCRIPTION OF PREFERRED EMBODIMENTS

As shown in FIG. 1 and assuming solely for the sake of convenience of the description and without limiting the scope of the invention, a set of three reference axes with a longitudinal direction X-X, transverse direction Y-Y and vertical direction Z-Z, respectively, as well as an upper part corresponding to the part for access to the clamping screw and a bottom part opposite to the first part, the terminal block according to the present invention comprises essentially a body 10 made of insulating material and having formed therein:

- a central chamber 11 for housing means 20 for clamping the ends 1*a*,2*a* of the electric wires 1,2 to be connected together electrically;
- two opposite seats 12 which are respectively open outwards on the sides 10*a*, 10*b* of the body 10 of the terminal block for inserting the said wires 1,2 in the longitudinal direction X-X;
- a front closing cover 10*c*.

In greater detail, said chamber 11 is connected to an upper opening 14 by means of a channel 13 extending in the vertical direction Z-Z and having, at a certain height, a hollow transverse extension 13*a* so as to form a seat for a screw 20 forming the part for operating the clamping means 30.

The interior of the chamber 11 is also provided with a first tooth 15 and a second tooth 16 extending in the longitudinal direction inwards, situated opposite each other and arranged at different heights in the vertical direction Z-Z so as to form retaining and/or end-of-travel parts for the clamping means as described more fully below.

Said screw 20 is housed with its head 21 inserted inside the transverse hollow extension 13*a* and threaded shank 22 extending downwards so as to mate with a corresponding female thread 32*d* of the wire clamping component 30.

In more detail, the wire clamping component 30 comprise a first metal jaw 31 and a second metal jaw 32 which are respectively formed by a folded plate so as to form a continuous base 31*a*, 32*a*, with a substantially parallelepipedal cross-section, and a plurality of lugs 31*b*, 32*b* having a cross-section substantially in the form of an isosceles triangle and discontinuous in the longitudinal direction X-X so as to form seats 31*c*,32*c* situated between two consecutive lugs 31*b*,32*b*.

In a preferred embodiment, the operating screw 20 and the female thread 32*d* of the second jaw 32 have respective threads able to cause the movement away from each other of the two jaws in the vertical direction Z-Z so that clamping of the wires is performed by means of pulling of the movable jaw 32 away from the stationary jaw 31.

The holes 12 are also configured with a cross-section substantially in the form of a truncated pyramid so as to ensure proper insertion of the wires in the correct relative position inside the clamps 31, 32, while preventing the entry of the wires if the jaws are not correctly open and therefore likely to cause poor electrical contact between the two wires.

During assembly, which is performed with the terminal block open on the front side:

- the first jaw 31 is inserted with its base housed in a corresponding seat situated between the bottom surface of the first tooth 15 and the bottom surface of the second tooth 16 so that the two undercuts ensure retention of the first jaw 31 which is clamped in the vertical direction Z-Z, and with lugs 31*b* extending in the same direction upwards;
- the second jaw 32 is arranged opposite the first jaw so that the respective lugs 32*b*, 31*b* are inserted vertically inside the corresponding seats 31*c*,32*c* and with the base 32*a* resting on the upper surface of the first tooth 15 and the second end-of-travel tooth 16 in the vertical direction;
- in this way the base 32*a* of the second jaw 32 is situated opposite the shank 22 of the screw 20 which may engage with a corresponding female thread 32*d* in the said base 32*a*.

With this configuration, the operating principle of the terminal block is as follows:

- the wire clamp 30 is arranged with the jaw 32 pushed by the screw 20 against the upper surface of the bottom end-of-travel tooth 16, so as to ensure maximum relative opening in the vertical direction of the two jaws 31,32;
- the wires 1 and 2 are inserted inside the respective opposite openings 12 of the body 10 so that the exposed ends 1*a*,2*a* extend over the entire length of the wire clamping component 30 in the longitudinal direction X-X;
- the screw 20 is tightened and, reacting with its head 21 against the fixed seat 13*a*, causes the displacement in the vertical direction Z-Z of the upper jaw 32 which moves away from the first jaw 31 and causes a reduction in the volume present between the two opposite vertices of the isosceles triangle part of the two jaws 31,32, thereby causing automatic centring and clamping of the two wires 1*a*,2*a* against each other, at the respective vertex of the two triangles, thus producing a reliable electric contact between the said wires.

It is pointed out moreover that, within the same longitudinal volume, the clamping action of the jaws performed by means of pulling produces a plurality of points of electrical contact between the two wires, ensuring reliable conduction.

It is therefore clear that the terminal block according to the invention results in a significant improvement compared to the known art since the particular form of the clamping jaws ensures that:

- there is reliable and repeatable centring and clamping with relative contact of the two wires 1,2;
- the terminal block is substantially independent of the diameter of the wire which may have a larger diameter (FIG. 3*a*) or smaller diameter (FIG. 3*b*) without risks for the correct functioning of the connection.

In addition to this, the movable jaw is operated by means of a single operating screw with a reduction in the parts and assembly costs.

Moreover, the electrical contact is performed by means of only two electric wires, without the direct action of screws and the two jaws only have a mechanical clamping function, with the result that they may also be made of low-cost and/or insulating materials.

The invention claimed is:

1. Terminal block comprising a body having a chamber adapted for housing a clamp, the body including at least one opening adapted for receiving at least one end of an electric cable extending parallel to a longitudinal direction of the body and at least one access opening for access to an operating mechanism, a clamp adapted for retaining at least one end of an electric cable, the clamp including a first jaw and a second jaw, each jaw including a base portion extending parallel to the longitudinal direction, a pair of lugs extending from the base portion and positioned along the base portion to form a seat disposed between the lugs, each lug having a triangular shaped opening, the jaws being disposed in the housing situated opposite each other wherein the seat of one jaw aligns with the lug of the other jaw and the triangular shaped opening in each of the lugs is aligned along the longitudinal direction for insertion of at least one end of the electric cable.

2. A terminal block according to claim 1, wherein said first jaw is fixed.

3. A terminal block according to claim 1, wherein said second jaw is movable with respect to the first jaw in a direction transverse to the longitudinal direction by operation of said operating mechanism.

4. A terminal block according to claim 1, wherein said operating mechanism operates by pulling the second jaw.

5. A terminal block according to claim 1, wherein the first jaw and the second jaw of the clamp are respectively formed by a plate folded so as to form a continuous base having a substantially parallelepidal cross-section and integral with the lugs having a cross-section substantially in the form of an isosceles triangle.

6. A terminal block according to claim 1, wherein said housing includes a first tooth projecting into the chamber along the longitudinal direction and is adapted to retain the first jaw in the housing and act as an end-of-travel stop for the second jaw in a direction transverse to the longitudinal direction.

7. A terminal block according to claim 1, wherein said housing includes a second tooth projecting into the chamber along the longitudinal direction to form an end-of-travel stop for the second jaw and to retain the first jaw in the housing.

8. A terminal block according to claim 1, wherein at least one of the openings in the housing has a cross-section substantially in the form of a truncated pyramid with the vertex directed inwards.

9. A terminal block according to claim 1, further comprising a front closing cover.

10. A terminal block according to claim 1, wherein at least one component of the clamp is made of non-conductive material.

11. A terminal block according to claim 1 wherein at least one component of the operating mechanism is made of a non-conductive material.

12. A terminal block according to claim 1, wherein said chamber is connected to an upper opening by means of a channel extending in a direction transverse to the longitudinal direction.

13. A terminal block according to claim 12, wherein said channel extends a vertical direction and has a hollow extension extending in the longitudinal direction to form the seat for retaining the operating mechanism.

14. A terminal block according to claim 13, wherein said operating mechanism includes a screw with head inserted in the hollow extension and having a threaded shank extending downwards and engaging a corresponding thread of the second jaw.

15. A terminal block according to claim 14, wherein the screw and the thread of the second jaw have predetermined thread dimensions to determine the movement of the jaws away from each other in a vertical direction.

* * * * *